US005825896A

United States Patent [19]

Leedom

[11] Patent Number: 5,825,896

[45] Date of Patent: Oct. 20, 1998

[54] HINGED HEARING AID

[75] Inventor: Marvin Allan Leedom, Princeton, N.J.

[73] Assignee: David Sarnoff Research Center Inc., Princeton, N.J.

[21] Appl. No.: 673,676

[22] Filed: Jun. 26, 1996

[51] Int. Cl.[6] ..... H04R 25/00

[52] U.S. Cl. ..... 381/69; 381/68.6; 381/69.2

[58] Field of Search ..... 381/68.6, 69, 69.2, 381/68, 68.7

[56] References Cited

U.S. PATENT DOCUMENTS 5,185,802 2/1993 Stanton ..... 381/68.6

*Primary Examiner*—Sinh Tran

*Attorney, Agent, or Firm*—William J. Burke

[57] ABSTRACT

A hinged hearing aid to allow for ease of inserting the hearing aid into the ear canal with a portion of the hearing aid extending around a bend in the ear canal. The hearing aid includes a boot of a flexible material having two hollow portions. A flexible circuit has mounted thereon a speaker, battery, microphone and electronic components. A portion of the flexible circuit having the speaker and battery thereon is mounted in one of the boot portions and the portion of the flexible circuit having the microphone and electronic components thereon is mounted in the other boot portion. The boot portions are hingedly connected together. A portion of the flexible circuit extends between the boot portions to form at least a portion of the hinge between the boot portions. The boot may have a portion which connects the two boot portions to also form a portion of the hinge.

15 Claims, 4 Drawing Sheets

HINGED HEARING AID

The invention relates to a hinged hearing aid, and, more particularly, to a hearing aid formed of two parts which are hingedly connected together so as to provide a more comfortable and secure fit into the ear of the user than current hearing aids.

BACKGROUND OF THE INVENTION

A hearing aid, in general, comprises a housing or ear mold which contains a speaker, a microphone, electronic circuitry connecting the speaker and the microphone, and a battery for operating the electronic circuitry. The housing is an ear mold which fits into the ear canal of the user. The shape of various ear canals are very complex. The cross-section of the smallest area in the ear varies from a flat ellipse to a circle with a large number of sizes of each shape. This is further complicated by the fact that the ear canal bends up to 90° in many ears. Standard hearing aids are custom fitted to each individual and constructed from a hard plastic which should fit the ear canal perfectly. This custom fitting is an expensive and time consuming process which greatly increases the cost of the hearing aid and because it is hard and durable it is generally uncomfortable.

To greatly reduce the cost of a hearing aid, a disposable hearing aid has been developed. For such a hearing aid, the electronics and its packaging has been designed so as to greatly reduce the overall cost of the hearing aid. Also, the housing containing the electronics of the hearing aid is mounted in an ear mold which is of a soft, pliant but durable material so that the ear mold molds itself to the shape of the ear canal to achieve a good fit. Thus, it is not necessary to custom design the ear mold to each user's ear. However, such disposable hearing aids still have the problem that they are still too stiff to pass the bend in the ear canal and slip completely into the canal.

SUMMARY OF THE INVENTION

The invention is directed to a hearing aid which includes a boot of a flexible material having first and second hollow portions. A speaker and a battery are in the first portion of the boot, and a microphone and electronic components are in the second portion of the boot. The two boot sections are hingedly connected together. The speaker, battery, microphone and electronic components are mounted on a flexible circuit. A portion of the flexible circuit extends between the first and second boot portions and forms at least a portion of the hinge between the boot portions. The boot may have a portion which connects the boot portions and also forms a part of the hinge.

BRIEF DESCRIPTION OF THE DRAWING

The teachings of the invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
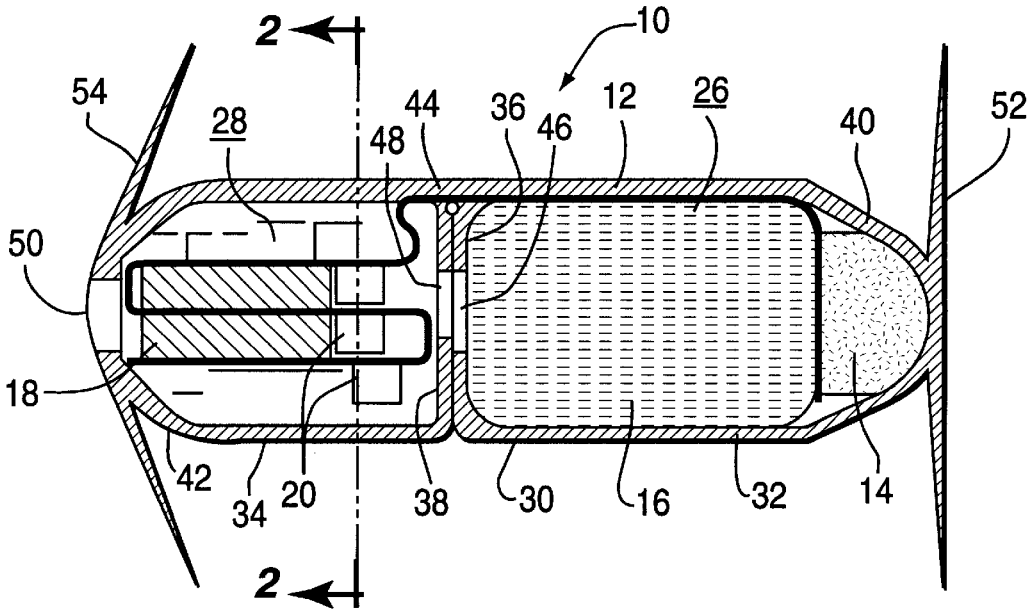
FIG. 1 is a sectional view of one form of the hinged hearing aid of the present invention.
Figure 2:
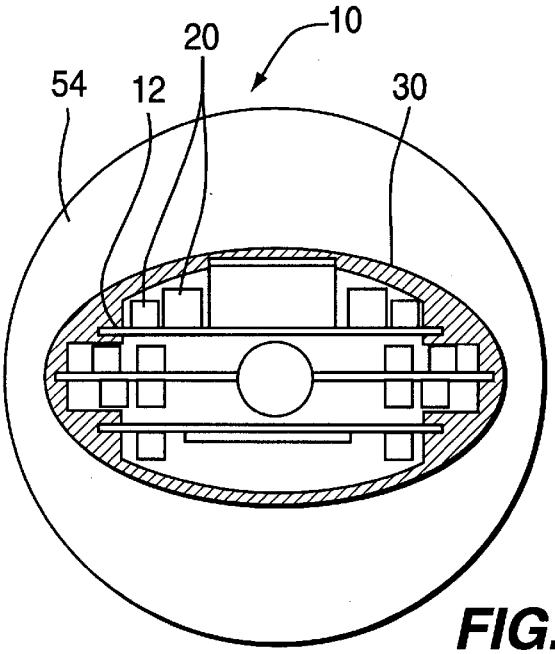
FIG. 2 is a sectional view taken along line 2—2 of FIG. 1.
Figure 4:
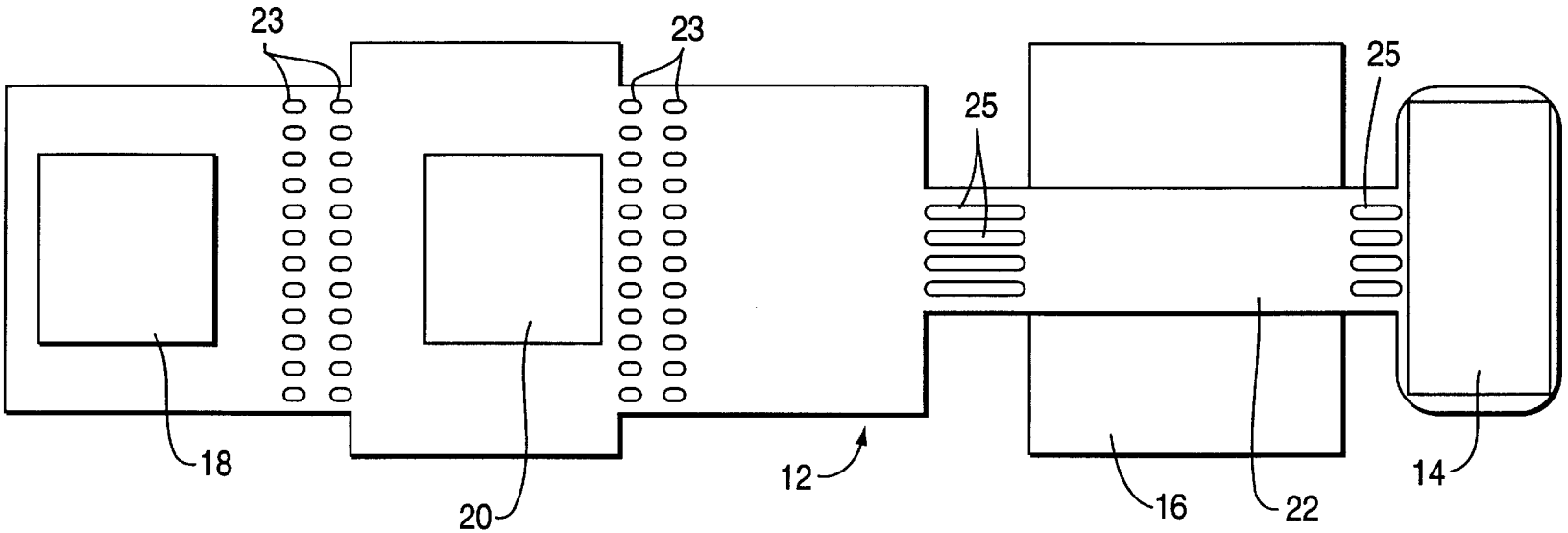
FIG. 4 is a top view of the unfolded electronics of the hearing aid of the present invention.
Figure 5:
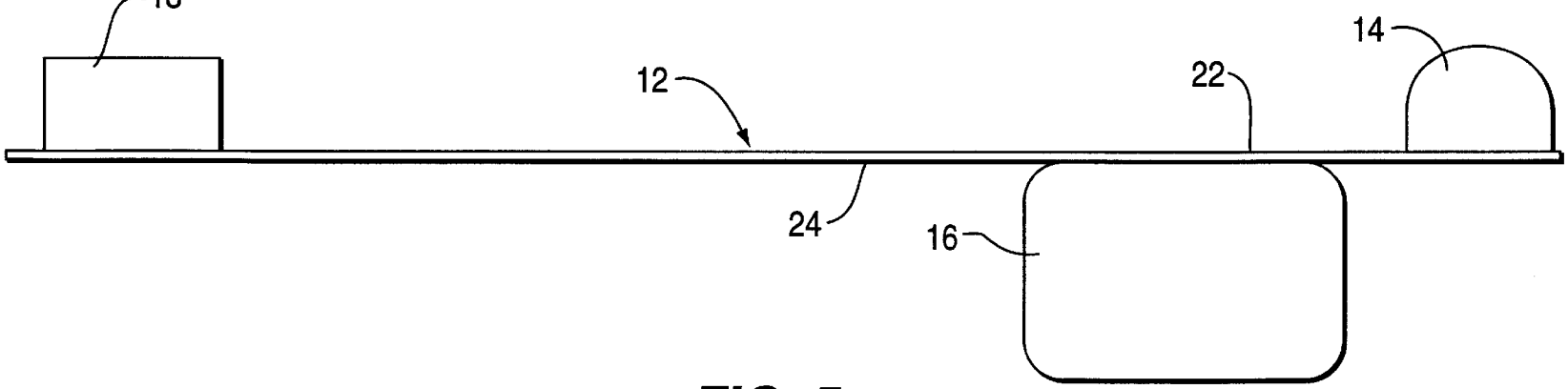
FIG. 5 is a side view of the unfolded electronics of the hearing aid of the present invention.

Referring to FIGS. 1 and 2, one form of the hinged hearing aid of the invention is generally designated as 10. Hearing aid 10 comprises a flexible circuit 12 having mounted thereon a speaker 14, a battery 16 a microphone 18 and electric circuit components 20. As shown in FIGS. 4 and 5, the flexible circuit 12 is a strip of a flexible, insulating material, such as a plastic having a pattern of conductive strips (not shown) on the surfaces thereof. The speaker 14 is mounted on one surface 22 of the strip at one end thereof, and the microphone is mounted on the one surface 22 at the other end of the strip. The battery 16 is mounted on the opposite surface 24 of the strip adjacent the speaker 14. The electronic circuit components 20, such as integrated circuits, coils, transducers, resistors, capacitors, etc., are mounted on either or both surfaces 22 and 24 of the strip adjacent the microphone 18. The speaker 14, battery 16, microphone 18 and electronic circuit components 20 are connected to the conductive strips so as to be electrically connected together in a desired circuit.

As shown in FIG. 4, the flexible strip of the flexible circuit 12 has a plurality of spaced rows of holes 25 therethrough. The holes 25 are arranged in rows extending transversely across the strip and the rows of holes 25 are spaced along the strip. Each row of holes 25 provides a bend line so that the strip can be folded. As shown in FIG. 1, the strip is folded at one end so that the speaker 14 extends across one side of the battery. At the other end of the strip, the strip is folded in a serpentine fashion so that the microphone 18 and the electronic circuit components 20 are in a stacked relation. This forms the flexible circuit 12 into two cores 26 and 28 with the speaker 14 and battery 16 being part of one core 26 and the microphone 18 and electronic circuit components 20 being a part of the other core 28.

The flexible circuit 12 is mounted in a boot 30 of a flexible material, such as a plastic or rubber. The boot 30 comprises two hollow portions 32 and 34 which, as shown in FIG. 2, are elliptical in transverse cross-section. Each portion 32 and 34 of the boot 30 has a flat base 36 and 38 respectively at one end and a rounded tip 40 and 42 respectively at its other end. The two portions 32 and 34 of the boot 30 are connected together at their bases 36 and 38 by a flexible hinge 44. Each of the bases 36 and 38 has an opening 46 and 48 respectively therein. The portion 34 also has an opening 50 in the tip 42 thereof to allow sound to reach the microphone 18. Flexible wings 52 and 54 project radially outwardly from each of the portions 32 and 34 at the tips 40 and 42.

Figure 3:
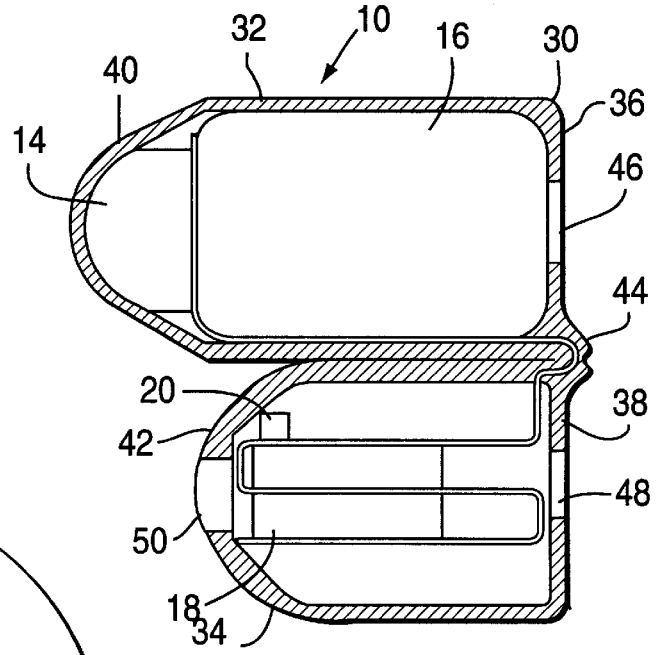
FIG. 3 is a sectional view of the hearing aid shown in FIG. 1 in its folded condition.

The core 26 containing the speaker 14 and battery 16 is within the portion 32 of the boot 30 with the speaker being at the tip 38 of the portion 32. The core 28 containing the microphone 18 and electronic components 20 is within the portion 34 of the boot 30 with the microphone 18 being adjacent the opening 50. The portion of the flexible circuit 12 which is between the two cores 28 and 30 extends along the hinge 44 to form a part of the hinge. Each of the cores 28 and 30 is inserted in its respective portion 32 and 34 of the boot 30 through the openings 46 and 48 in the bases 36 and 38. This can be achieved by bending the boot 30 so that the two portions 32 and 34 are parallel to each other as shown in FIG. 3. This leaves the openings 46 and 48 exposed so that the cores 26 and 28 can be inserted through the openings 46 and 48 into the respective portions 32 and 34. The speaker 14, battery 16, microphone 18 and circuit components 20 are mounted on the flexible circuit 12 while the flexible circuit 12 is flat. The complete circuit can then be tested and, if satisfactory, the flexible circuit 12 is folded into the cores 28 and 30 which are inserted in the boot portions 32 and 34.

When the hearing aid 10 is to be used, the user inserts the boot portion 32, which contains the speaker 14, into his/her ear first. When the boot portion 32 reaches the bend in the ear canal, it can turn around the bend as a result of the hinge 44 between the boot portions 32 and 34. The hearing aid 10 is inserted into the ear until the boot portion 34 is completely within the ear. The wings 52 and 54 on the boot portions 32 and 34 provide a snug fit of the boot 30 in the person's ear. Thus, since the hearing aid 10 is formed of two boot portions 32 and 34 which are hinged together, the hearing aid can be inserted completely into the ear with the boot portion 32 extending around the bend in the air canal.

Figure 6:
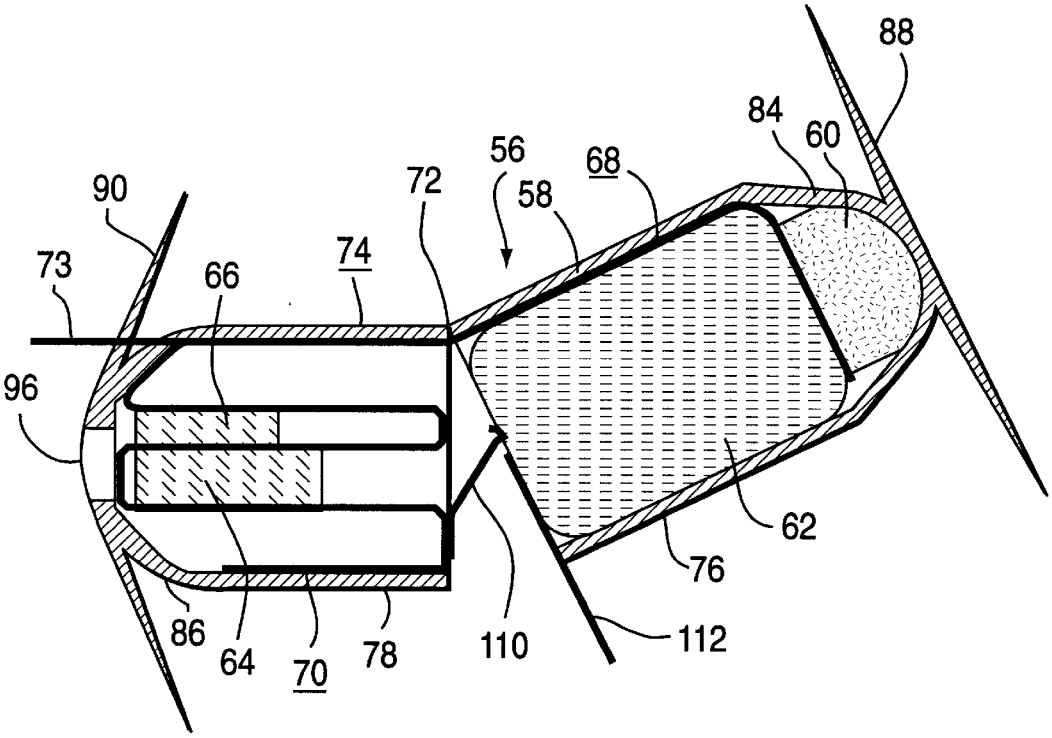
FIG. 6 is a sectional view of another form of the hinged hearing aid of the present invention.
Figure 7:
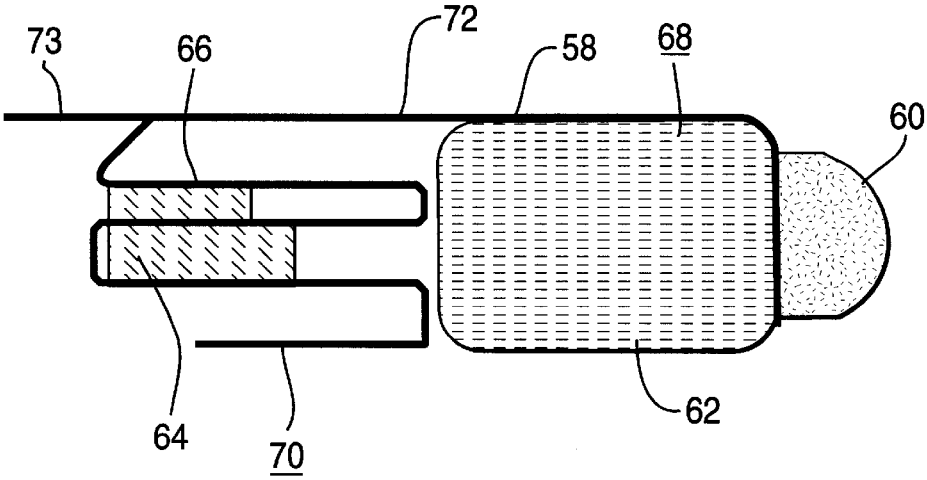
FIG. 7 is a sectional view of the folded electronics of the hearing aid shown in FIG. 6.

Referring now to FIG. 6, another form of the hearing aid of the invention is generally designated as 56. Hearing aid 56 comprises a flexible circuit 58 having thereon a speaker 60, a battery 62, a microphone 64 and electronic components 66. The flexible circuit 58 is of a structure similar to the flexible circuit 12 of the hearing aid 10 shown in FIGS. 4 and 5. The speaker 60 is mounted on the flexible circuit 58 adjacent one end thereof and on one side thereof. The battery 62 is mounted on the flexible circuit 58 adjacent the speaker 60 but on the opposite side of the flexible circuit 58. The microphone 64 is mounted on the flexible circuit 58 at the other end thereof and on the same side as the speaker 60. The electronic components 66 are mounted on the flexible circuit 58 adjacent the microphone 64. The flexible circuit is folded to form two core portions 68 and 70 as shown in FIG. 7. The core portion 68 contains the speaker 60 and the battery 62 with the speaker 60 being at one end of the battery 62. The core portion 70 is folded so that the microphone 64 and the electronic components 66 are in stacked relationship. The core portions 68 and 70 are connected together by a hinge 72. The core portion 70 has a tab 73 extending therefrom. The tab 73 may be a portion of the flexible circuit 58 or a separate piece attached to and extending from the flexible circuit 58.

Figure 8:
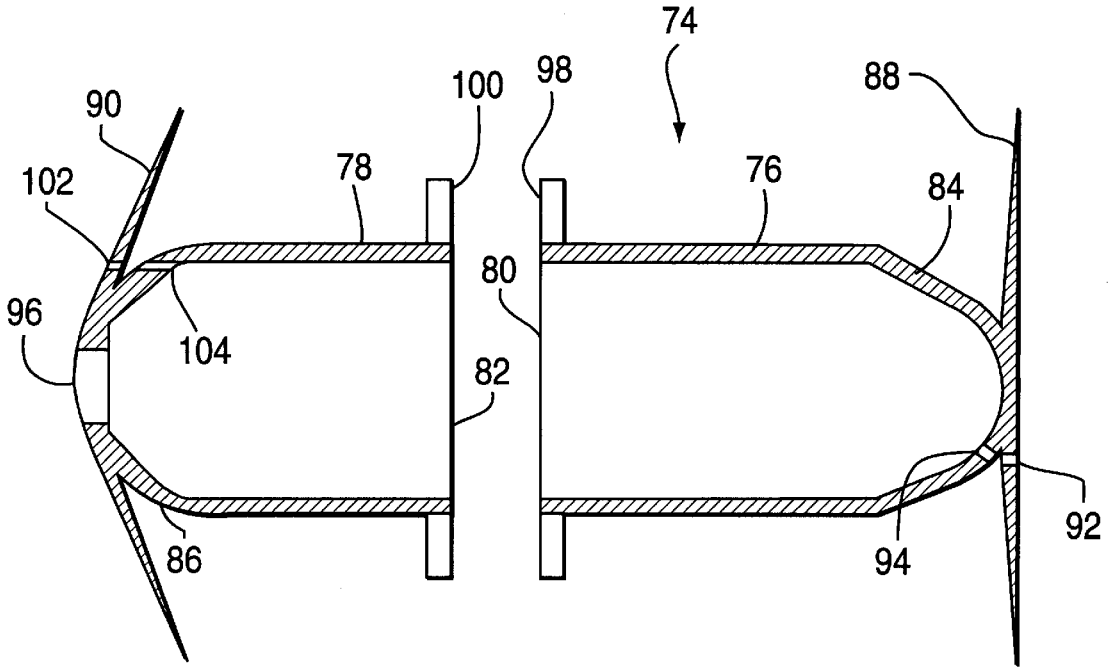
FIG. 8 is a sectional view of the ear mold of the hearing aid shown in FIG. 6.

The core portions 68 and 70 are mounted within a boot 74 of a flexible material. The boot 74 is preferably elliptical in transverse cross-section similar to the boot 30 of the hearing aid 10 shown in FIGS. 1 and 2. As shown in FIG. 8, the boot 74 is formed of two tubular portions 76 and 78. The boot portions 76 and 78 each have one open end 80 and 82 respectively, and conical closed ends 84 and 86 respectively. A flexible wing 88 and 90 respectively projects radially outwardly from the closed ends 84 and 86 of the boot portions 76 and 78. The wing 88 on the boot portion 76 has a small hole 92 therethrough adjacent the conical end 84 of the boot portion 76. A small hole 94 extends through the conical end 84 of the boot portion 76 adjacent the hole 92 in the wing 88. The boot portion 78 has an opening 96 in the very end of its conical end 86 to allow sound to enter the boot portion 78. Ears 98 and 100 project radially outwardly from the boot portions 76 and 78 respectively at the open ends 80 and 82 thereof. A small hole 102 extends through the wing 90 on the boot portion 78 adjacent the conical end 86 of the boot portion 78, and a small hole 104 extends through the conical end 86 of the boot portion 78 in alignment with the hole 102 in the wing 90.

As shown in FIG. 6, the core portion 68 fits within the boot portion 76 with the speaker 60 being within the conical end 84 thereof and adjacent the small hole 94 in the conical end 84. The core portion 70 fits within the boot portion 76 with the microphone 64 being adjacent the opening 96 in the conical portion 86 of the boot portion 76. The tab 73 extends through the aligned holes 102 and 104 in the wing 90 and the conical end 86 of the boot portion 78, and projects beyond the conical end 86. The hinge 72 of the flexible circuit 58 connects the two boot portions 76 and 78 but allows one boot portion to hinge with respect to the other boot portion. The ears 98 and 100 serve to assist in the insertion of the core portions 68 and 70 into the boot portions 76 and 78. After the core portions 68 and 70 are inserted into the boot portions 76 and 78, the ears 98 and 100 can be removed, such as by cutting or tearing them off.

A leaf spring 110 is secured at one end to a conductor on the portion of the flexible circuit 58 forming the core 70. The other end of the leaf spring 110 engages a contact of the battery 62 so as to electrically connect the battery 62 to the flexible circuit 58. The leaf spring 110 provides the electrical connection between the battery 62 and the flexible circuit 58 while allowing the boot portions 76 and 78 to hinge with respect to each other. However, if one boot portion is hinged 90° with respect to the other boot portion, the spring will leave the battery 62 so as to disconnect the battery 62 from the flexible circuit 58. Thus, when the hearing aid 56 is not is use, the boot portions can be hinged so as to disconnect the battery 62 and thereby provide for a longer life of the battery 62. Also, this exposes a sealing tape 112 which can be placed over an opening (not shown) in the battery 62 and thereby inactivate the battery 62.

The hearing aid 56 is used in the same manner as previously described with regard to the hearing aid 10 shown in FIG. 1. The boot portion 76 containing the speaker 60 is inserted into the ear first. When the boot portion 76 reaches the bend in the ear canal, it can hinge with respect to the boot portion 78 so that the hearing aid 56 can be easily inserted completely into the ear canal. The wings 88 and 90 provide for a tight fit of the hearing aid 56 in the ear. The holes 92 and 94 serve as speaker ports to allow the sound from the speaker 60 to enter the ear canal. The tab 73 extending from the end of the boot portion 78 provides for ease of removing the hearing aid 56 from the ear by pulling on the tab 73. In most hearing aids, the speaker port is easily clogged with ear wax. If the user attempts to clean the wax from the speaker port by inserting a sharp object into the speaker port, the speaker can be damaged. However, in the hearing aid 56 of the present invention, the wing 88 on the end of the boot portion 76 wipes the wax away as the hearing aid is inserted into the ear. If the hole 92 in the wing 88 becomes clogged with ear wax, it can be cleaned out by inserting a sharp object into the hole 92 without getting near to the speaker 60. Thus, ear wax can be removed without the chance of damaging the speaker 60.

Thus, there is provided by the invention a small, compact hearing aid formed of two parts which are hinged together. Thus, when the hearing aid is inserted in the ear canal, one portion can hinge with respect to the other to allow the one portion to easily pass around the bend in the ear canal. This permits the hearing aid to be easily inserted completely within the ear canal. Also, the hearing aid does not have to be specially designed for the specific ear of the user, but will fit into many different ear sizes. This provides a hearing aid of much simpler design and less expensive to manufacture.

What is claimed is:

1. An in the ear hearing aid comprising:

a boot of flexible material which is adapted to be completely inserted into the ear canal and having first and second hollow portions;

a speaker and a battery in the first boot portion;

a microphone and electronic components in the second boot portion; and a strip of a flexible material extending between and hingedly connecting the first and second boot portions so that one boot portion can pivot with respect to the other bootportion.

2. The hearing aid in accordance with claim 1 further comprising a flexible circuit with the speaker, battery, microphone and electronic components being mounted on the flexible circuit, and a portion of the flexible circuit extends between the first and second boot portions and forms at least a part of the (hinge connection) flexible strip which extends between the boot portions.

3. The hearing aid of claim 2 in which the boot portions are substantially elliptical in transverse cross-section.

4. The hearing aid in accordance with claim 2 in which the boot has a portion extending between and hingedly connecting the first and second boot portions, and forms a least a part of the flexible strip.

5. The hearing aid of claim 4 in which each boot portion has a substantially flat base at one end and a conical tip at its other end and the boot portions are hingedly connected together at the base ends.

6. the hearing aid of claim 5 in which the base of each boot section has an opening therethrough to allow the flexible circuit and its mounted components to be inserted therethrough into the boot portion.

7. The hearing aid of claim 5 including a flexible wing projecting substantially radially from each of the boot portions.

8. The hearing aid of claim 7 in which each of the wings is at the conical tip end of the boot portion.

9. The hearing aid of claim 2 in which each of the boot portions is open at one end and has a conical tip at its other end, and the boot portions are hingedly connected together at the open ends.

10. The hearing aid of claim 9 further comprising a tab extending from the flexible circuit and extending through holes in the conical end of the second boot portion.

11.The hearing aid of claim 10 in which the second boot portion has an opening in its conical end to allow sound to reach the microphone in the second boot portion.

12. The hearing aid of claim 11 further comprising a flexible wing projecting substantially radially from the conical end of each of the boot portions.

13. The hearing aid of claim 12 in which the wing on the first boot portion has a small hole therethrough adjacent the boot portion, and the first boot portion has a small hole through its conical end adjacent the hole in the wing.

14. The hearing aid of claim 13 further comprising a leaf spring extending between a contact on the battery in the first boot portion and a contact on the flexible circuit in the second boot portion to electrically connect the battery to the flexible circuit.

15. The hearing aid of claim 14 in which one end of the leaf spring is secured to the flexible circuit and the other end of the leaf spring engages the contact on the battery.

* * * * *